US008604941B2

(12) United States Patent
Milon et al.

(10) Patent No.: US 8,604,941 B2
(45) Date of Patent: Dec. 10, 2013

(54) DEVICE FOR DETECTING THE PASSING OF INDIVIDUALS

(75) Inventors: Christophe Milon, Lannion (FR); Jean-Claude Dubois, Lannion (FR)

(73) Assignee: ECO Compteur, Lannion (FR)

( * ) Notice: Subject to any disclaimer, the term of this patent is extended or adjusted under 35 U.S.C. 154(b) by 233 days.

(21) Appl. No.: 13/146,131

(22) PCT Filed: Feb. 1, 2010

(86) PCT No.: PCT/EP2010/051173

§ 371 (c)(1),
(2), (4) Date: Aug. 31, 2011

(87) PCT Pub. No.: WO2010/089272

PCT Pub. Date: Aug. 12, 2010

(65) Prior Publication Data

US 2011/0304383 A1 Dec. 15, 2011

(30) Foreign Application Priority Data

Feb. 4, 2009 (FR) ..... 09 50688

(51) Int. Cl.
*G08G 1/07* (2006.01)

(52) U.S. Cl.
USPC ..... 340/917; 340/573.1; 340/665; 340/666; 340/667; 340/668

(58) Field of Classification Search
USPC ..... 340/917, 573.1, 665, 666, 667, 668
See application file for complete search history.

(56) References Cited

U.S. PATENT DOCUMENTS

| | | | | |
|---|---|---|---|---|
| 3,748,443 | A | 7/1973 | Kroll et al. | |
| 5,656,801 | A * | 8/1997 | Goren et al. | 235/98 R |
| 6,195,921 | B1 * | 3/2001 | Truong | 36/136 |
| 6,330,346 | B1 * | 12/2001 | Peterson et al. | 382/115 |
| 7,049,830 | B1 * | 5/2006 | Thinnes | 324/691 |
| 2006/0171570 | A1 | 8/2006 | Brendley et al. | |

FOREIGN PATENT DOCUMENTS

WO WO 00/75417 12/2000

OTHER PUBLICATIONS

International Search Report for PCT/EP2010/051173, mailed Apr. 14, 2010.
Foreign-language Written Opinion of the International Searching Authority for PCT/EP2010/051173, mailed Apr. 14, 2010.

* cited by examiner

*Primary Examiner* — Daryl Pope
(74) *Attorney, Agent, or Firm* — Nixon & Vanderhye, PC

(57) ABSTRACT

The invention relates to a device (100) for detecting the passing of individuals in the form of a mat including:

a printed circuit board (104), one of the surfaces which supports a plurality of contactors designed to change state under the pressure exerted by a foot or a wheel, and at least one of the surfaces of which supports at least one electronic component (112) not subject to any pressure from said foot: and for the or each surface supporting at least one electronic component (112), a protective layer (106) attached to said surface and incompressible under the weight of individuals/trolleys, the or each electronic component (112) being recessed in a hole (110) in said incompressible protective layer (106).

12 Claims, 3 Drawing Sheets

DEVICE FOR DETECTING THE PASSING OF INDIVIDUALS

This application is the U.S. national phase of International Application No. PCT/EP2010/051173, filed 1 Feb. 2010, which designated the U.S., and claims priority to FR application No. 09/50688, filed 4 Feb. 2009, the entire contents of which is hereby incorporated by reference.

The present invention concerns a device for detecting passing, as well as a detection and/or counting system comprising at least one such detection device.

Detecting the passing of individuals at a passage zone requires the installation of a passage detection device.

Such a detection device is known that takes the form of a mat comprising a plurality of contactors that change state when a foot presses on same. Such change in state is received by an analysis and monitoring unit that deduces therefrom the position of each foot and the number of individuals that pass.

The operating principle of such a detection device generally requires a matrix arrangement of the sensors with a high density on the ground of such sensors. The traffic over the mat prevents the integration of active or passive electronic components in the said detection device, otherwise they would be crushed by the feet. It is then necessary to offset these components in a housing external with respect to the said detection device, thus creating problems of complexity of routing relating to the very large number of wire connections, distance and processing of the detection device.

One object of the present invention is to propose a passage detection device that does not have the drawbacks of the prior art and in particular allows mechanically secure integration of the electronic components in the passage zone of the detection device.

To this end, a device for detecting the passing of individuals is proposed in the form of a mat comprising:

- a printed circuit board one of the faces of which carries a plurality of contactors designed to change state under a pressure exerted by a foot or a wheel and at least one of the faces of which carries at least one electronic component not subject to any pressure from said foot, and
- for the or each face carrying at least one electronic component, a protective layer fixed against the said face and incompressible under the weight of individuals/trolleys, the or each electronic component being housed in a hole in said incompressible protective layer.

Advantageously, the or each hole in the incompressible layer is a through hole.

Advantageously, the electronic component or components are active components of the type for receiving information from each contactor, analysing the said information thus received, characterising the feet or wheels that activate the said contactors, or transmitting the said characterisation to a central system.

According to a particular embodiment, when one of the faces of the printed circuit board carries both one or more electronic components and the plurality of contactors, the corresponding protective layer forms an activation layer comprising, for each contactor, a hammer able to move elastically between an idle position in which it does not activate the said contactor and an activation position in which it does activate the said contactor.

Advantageously, the passage detection device comprises:

- a bottom protective layer fixed under the printed circuit board, capable of absorbing the irregularities in the ground without damaging the electronic components integrated in the incompressible layer,

- a thermoformed intermediate layer fixed between the printed circuit board and the activation layer, and
- a top protective layer impervious to dust and water splashes, fixed to the activation layer.

According to another particular embodiment, when only the face of the printed circuit board opposite to the face carrying the plurality of contactors carries one or more electronic components, the detection device comprises a thermoformed activation layer fixed to the face carrying the plurality of contactors and comprising, for each contactor, an elastic zone able to move vertically between an idle position in which it does not activate the said contactor and an activation position in which it does activate the said contactor.

Advantageously, the hammer or respectively the elastic zone comprises a protrusion that extends above the top surface of the said hammer or respectively the said elastic zone, so that, when the hammer or respectively the elastic zone is in the activation position, the protrusion projects with respect to the top surface of the activation layer.

The invention also concerns a detection and/or counting system comprising at least one detection device according to one of the above variants and a central system intended to determine the presence, number and/or direction of passage of each individual from the information transmitted by the electronic component or components of the or each detection device.

Advantageously, when there are several detection devices in order to be able to adapt to different passage widths, they are linked step by step by a serial connection of n wires.

Advantageously, the connections of n wires between two consecutive detection devices are redundant.

Advantageously, when there are several detection devices, they are connected step by step by connection means of the flexible hinge type.

The features of the invention mentioned above, as well as others, will emerge more clearly from a reading of the following description of an example embodiment, the said description being given in relation to the accompanying drawings, among which:

Figure 1:
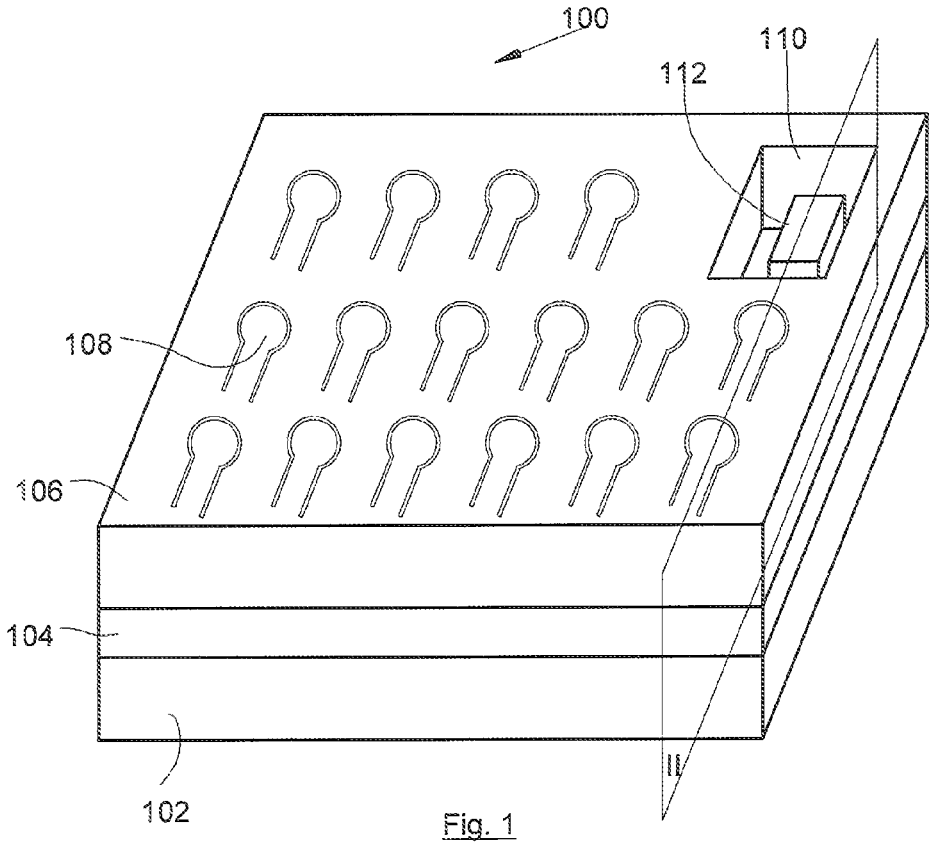
FIG. 1 shows a schematic representation of a device for detecting the passing of individuals according to the invention.

FIG. 1 shows a passage detection device 100 in the form of a mat. The detection device 100 is disposed on the ground where individuals pass, for example at a door. The detection device 100 comprises a printed circuit board 104 one of the faces (here the top face) of which carries a plurality of contactors 220 (FIG. 2) designed to change state under a pressure exerted by a foot or a wheel of a trolley and are thus activated when a pressure is exerted on them. The contactors 220 are disposed so as to form a matrix and are distributed on the surface of the detection device 100 so as to cover it and so that an individual crossing the detection device 100 is obliged to press simultaneously on at least one and preferably several of these contactors 220. The detection device 100 is preferably connected to a central system 302 (FIG. 3) which, from the information supplied by the detection device 100, determines the presence, number and/or direction of passage of each individual detected.

Figure 3:
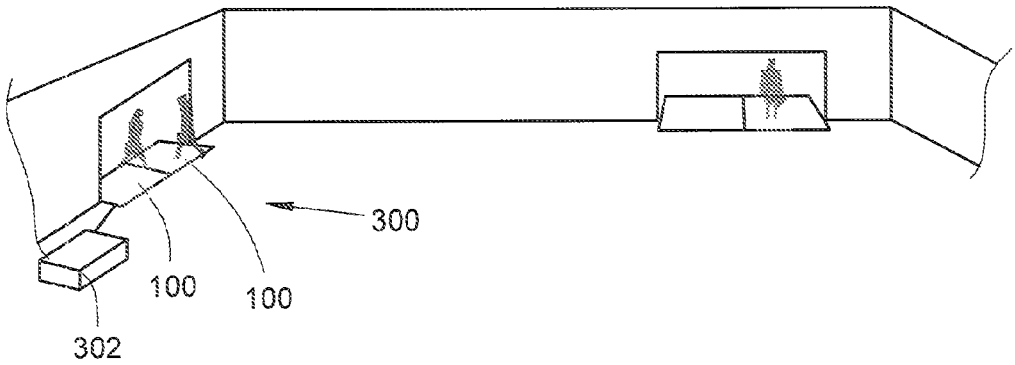
FIG. 3 shows a detection and/or counting system according to the invention.

FIG. 3 shows a detection and/or counting system 300 comprising at least one detection device 100 and the central system 302.

When a detection device 100 is juxtaposed with one or more other identical detection devices 100 so as to cover a more extensive surface, they are connected together in steps by connection means of the hinge type, and more particularly of the flexible hinge type, making it possible to fold the whole in the form of a compact concertina assembly.

When there are several detection devices 100 so as to be able to adapt to different passage widths, they are connected in steps by a serial connection with n wires as far as the central system 302, but they can be connected by any other connection system.

To avoid loss of information between the successive detection devices 100, the n-wire connections between two consecutive detection devices 100 are redundant. To create redundancy of information the passage of the n wires between two consecutive detection devices 100 takes place in a plurality of subassemblies, each of the n wires present in one of the subassemblies being duplicated in at least another subassembly. For example, a first assembly comprises the n wires while two other distinct subassemblies of the first assembly each contain n/2 wires, so that each of the n wires of the first assembly is duplicated in one of the other two subassemblies.

Figure 2:
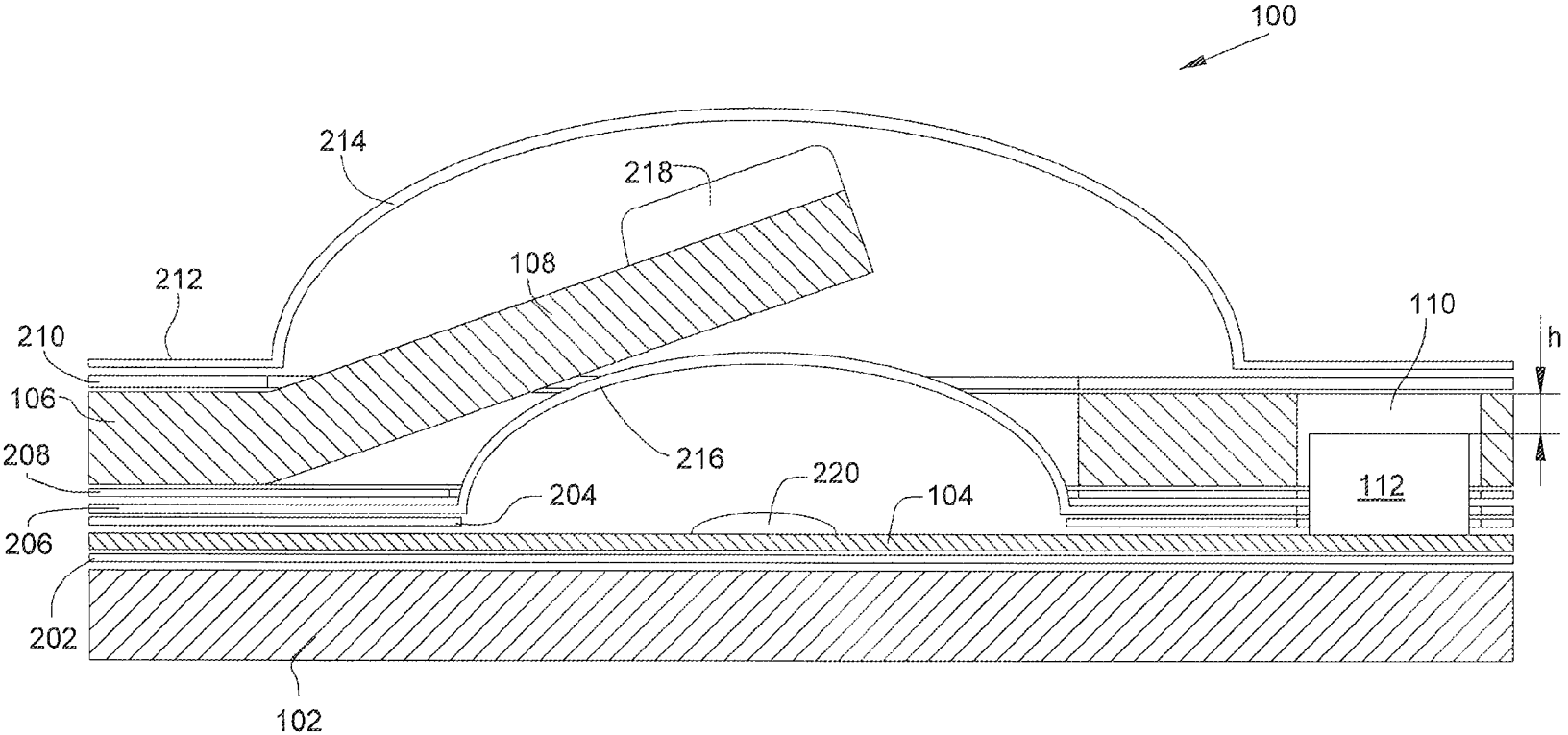
FIG. 2 is a section along the plane II in FIG. 1.

FIG. 2 shows the detection device 100 in section along the plane II of FIG. 1.

For reasons of cost, the printed circuit board 104 is preferably a single-phase flexible printed circuit board. On the top face of the printed circuit board 104, that is to say the face opposite to the ground, the contactors 220 and the electronic components 112 that are not to be subjected to any foot pressure, are fixed conventionally, for example by welding.

A protective layer 106 is fixed against the face carrying the electronic components 112. The protective layer 106 is incompressible under the weight of individuals or trolleys and each electronic component 112 is housed in a hole 110 in the protective layer 106.

The installation of the protective layer 106 and of the hole 110 makes it possible to house the active or passive electronic components 112 of the detection device 100 not subjected to a pressure, in particular of a foot, in order to prevent degradation or even destruction thereof. Integration of the electronic components 112 is thus optimised.

In the embodiment of the invention presented in FIGS. 1 and 2, the top face of the printed circuit board 104 carries both one or more electronic components 112 and the plurality of contactors 220, and the protective layer 106 forms an activation layer 106.

The detection device 100 comprises a bottom protective layer 102 intended to rest on the ground, the printed circuit board 104 fixed on top of the bottom protective layer 102, and the activation layer 106 fixed on top of the printed circuit board 104.

The different layers 102, 104 and 106 are connected together for example by adhesive bonding.

The bottom protective layer 102 is produced from a material for example of the expanded PVC type with a thickness of around 1000 μm to 1500 μm and has a function of protecting the printed circuit board 104 and the electronic components 112. The bottom protective layer 102 is capable of absorbing the irregularities of the ground, which could degrade the printed circuit board 104 and the electronic components 112.

The activation layer 106, which is here the protective layer, is produced from a material of the incompressible material type, such as for example PVC. In order to avoid any crushing of the electronic components 112 when an individual or a trolley passes, each electronic component 112 is housed in a through hole 110 in the activation layer 106. Each electronic component 112 thus has a fixing face in contact with the printed circuit board 104 and an exposed face oriented upwards, that is to say opposite to the ground.

Incompressibility is defined by the fact that, whatever the weight of the individuals/trolleys passing over the hole 110, it is physically impossible for the activation layer 106 to be elastically crushed so that the exposed face of at least one of the electronic components 112 comes to be flush with the crushed surface of the activation layer 106.

In other words, the height h between the top face of the activation layer 106 and the exposed face of the highest of the electronic components 112 is always less than the height over which the activation layer 106 can be crushed under the effect of the weight of individuals/trolleys.

Figure 4:
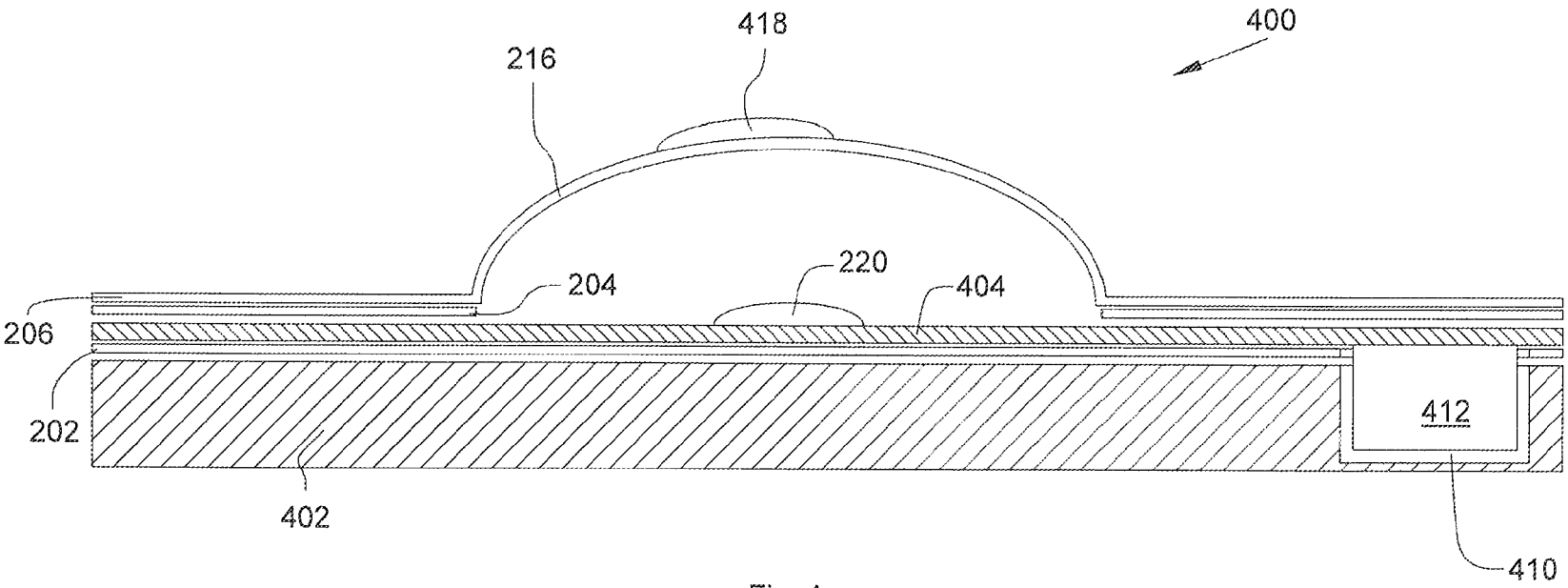
FIG. 4 shows a device for detecting the passing of individuals according to another embodiment of the invention.

FIG. 4 shows a detection device 400 according to another embodiment of the invention. In this other embodiment, the detection device 400 comprises a double-sided printed circuit board 404. The top face of the printed circuit board 404 carries a plurality of contactors 220. The bottom face and optionally the top face of the printed circuit board 404 carry at least one electronic component 412 not subjected to any pressure of a foot or wheel. Each face of the printed circuit board 404 that carries electronic components 412 is fixed against a protective layer 402 that is incompressible under the weight of individuals/trolleys, and each electronic component 412 is housed in a hole 410 in the incompressible protective layer 402. The hole 410 may be a through hole. The protective layer 402 is for example produced from the same material as the protective layer 106.

Thus, in general terms, the device 100, 400 for detecting the passing of individuals in the form of a mat comprises:

- the printed circuit board 104, 404, one of the faces of which carries the plurality of contactors 220 designed to change state under a pressure exerted by a foot or a wheel and at least one of the faces of which carries at least one electronic component 112, 412 that is not subjected to any pressure from the said foot, and
- for the or each face carrying at least one electronic component 112, 412, a protective layer 106, 402 fixed against the said face and incompressible under the weight of individuals or trolleys, the or each electronic component 112, 412 being housed in a hole 110, 410 in the said protective layer 106, 402.

In the embodiment of the invention presented in FIGS. 1 and 2, on top of each contactor 220 fixed to the printed circuit board 104, the activation layer 106 has a hammer 104 produced here in the mass of the said activation layer 106 and so as to project upwards with respect to the horizontal plane in which the top surface of the activation layer 106 lies. Thus, when an individual presses on the hammer 108, the latter is crushed and in its turn crushes and activates the contactor 220, which changes state. This change in state is then recognised and analysed by the electronic components 112 integrated in the detection device 100. Each hammer 108 has a certain elasticity, which enables it to crush the corresponding the contactor 220 and to return to its initial position, that is to say in a position in which it is not crushing the contactor 220. The hammer 108 is thus able to move elastically between an idle position in which it does not activate the contactor 220 and an activation position in which it does activate the contactor 220.

So that the crushing of the hammer 108 causes the crushing of the contactor 220 in a sure fashion, a protrusion 218 that extends above the top surface of the hammer 108 is provided. This protrusion 218 is such that, when the hammer 108 is in the activation position, it projects with respect to the horizontal plane in which the top surface of the activation layer 106 lies, that is to say with respect to the top face of the activation layer 106. The presence of the protrusion 218 causes a complementary crushing of the hammer 108 and provides the change in state of the contactor 220. The protrusion 218 can be a shape integrated in the hammer 108 or a hard element bonded to the hammer 108 such as for example a drop of resin with a thickness of around 0.5 mm to 1 mm.

In the embodiment of the invention shown in FIG. 2, the detection device 100, the thickness of which is preferably less than 6 mm, comprises, as from the ground:

the bottom protective layer 102,
a bottom adhesive layer 202,
the printed circuit board 104,
a bottom intermediate adhesive layer 204,
a thermoformed intermediate layer 206,
a top intermediate adhesive layer 208,
the activation layer 106,
a top adhesive layer 210, and
a top protective layer 212.

The bottom adhesive layer 202 has a thickness of preferably around 75 μm and takes the form of a double-sided adhesive that bonds the bottom protective layer 102 and the printed circuit board 104 together.

The thermoformed intermediate layer 206 is produced for example from thermoformed polyester and has a bubble 216 above each contactor 220.

The bottom intermediate adhesive layer 204 has a thickness of preferably around 125 μm and takes the form of a double-sided adhesive that bonds the printed circuit board 104 and the thermoformed intermediate layer 206 together.

The top intermediate adhesive layer 208 has a thickness of preferably around 350 μm and takes the form of a double-sided adhesive that bonds the thermoformed intermediate layer 206 and the activation layer 106 together.

The top protective layer 212 serves as protection for the various lower layers vis-à-vis external attacks. Thus it is impervious to dust and splashes of water. The top protective layer 212 is produced for example from PVC and has a thickness of around 125 μm.

The top adhesive layer 210 has a thickness of preferably around 75 μm and takes the form of a double-sided adhesive that bonds the activation layer 106 and top protective layer 212 together.

To enable the electronic components 112 to pass, the bottom intermediate adhesive layer 204, the thermoformed intermediate layer 206 and the top intermediate adhesive layer 208 are pierced at the points where the said electronic components 112 are arranged.

In the embodiment of the invention shown in FIG. 4, the detection device 400, the thickness of which is preferably less than 6 mm, comprises, as from the ground:

the protective layer 402, which constitutes a bottom protective layer,
a bottom adhesive layer 202,
the printed circuit board 404,
a bottom intermediate adhesive layer 204,
a thermoformed layer 206.

Other protective layers can be fitted on top of the thermoformed layer 206.

In the embodiment in FIG. 4, that is to say in the case where only the face of the printed circuit board 404 opposite to the face carrying the plurality of contactors 220 carries one or more electronic components 412, the activation layer of the detection device 400 is the thermoformed layer 206 which, for this purpose, has a bubble 216 above each contactor 220. The bubble 216 thus constitutes an elastic zone able to move vertically between an idle position in which it does not activate the contactor 220 and an activation position in which it does activate the contactor 220. So that the crushing of the bubble 216 causes the crushing of the contactor 220 in a sure fashion, a protrusion 418 that extends above the top surface of the bubble 216 is provided. The protrusion 418 is such that, when the elastic zone 216 is in the activation position, the protrusion 418 projects with respect to the top surface of the activation layer 206.

The electronic components 112, 412 integrated in a detection device 100, 400 are active components comprising in particular microprocessors for receiving the information from each contactor 220, analysing the information thus received, characterising the feet or wheels that pass over the said detection device 100, 400. The electronic components 112, 412 then generate a set of data representing these characterisations, which they send to the central system 302 of the detection and/or counting system 300.

The central system 302 then analyses the sets of data received from each detection device 100, 400 and derives therefrom a characterisation of the passage of the individuals or trolleys. The differentiation of the data received is carried out by means of an identifier that is transmitted simultaneously and is different for each detection device 100 of the detection and/or counting system 300.

For this purpose, the electronic components 112, 412 of each passage detection device 100, 400 comprise means for receiving information from each contactor 220 of the said detection device 100, 400, means for analysing the information thus received, means of characterising the feet that activate the contactors 220, and means of transmitting the characterisation to the central system 302.

Each detection device 100, 400 can thus function independently with respect to the other adjacent detection devices 100, 400 since it is the central system that analyses overall the sets of the data received without its being necessary for each detection device 100, 400 to have to exchange information with the adjacent detection devices 100, 400.

The characterisation of the feet consists, from the contactors 220 pressed in, of determining one or more of the following characteristics:

which phase of the passage of the foot is detected (arrival of the foot on the mat, maintenance of pressure, foot leaving mat),
in which direction the foot is moving,
what is the mean position of the foot,
what is the size of the foot,
which is the set of contactors 220 pressed in by the foot,
what is the time of this characterisation.

Such a characterisation makes it possible to limit the number of items of information to be transmitted to the central system, but any other type of transmission can be used.

The characterisation of a passage consists of a monitoring of the previous characteristics in order to monitor the progress of an individual and to count it in one direction of passage or another.

In a particular embodiment of the invention, the dimension of the detection device 100, 400 in the direction of passage is approximately 60 cm in order to collect sufficient information on one or more feet, the density of the contactors 220 is around 600 per $m^2$ and the spacing between two adjacent contactors 220 is around 3 cm in the direction perpendicular to the direction of passage.

Naturally the present invention is not limited to the examples and embodiments described and depicted but is capable of numerous variants accessible to persons skilled in the art.

For example, the invention has in particular been described in the case of a through hole which affords easy access to the electronic components that are found therein, but it applies in the same way in the case of a blind hole, as long as the pressure exerted by a foot does not bring the bottom of the blind hole in contact with the electronic components that are housed therein.

The invention claimed is:

1. Counting system (300) for counting a number of individuals or trolleys passing through a passage, the counting system (300) comprising:

a detection device (100, 400) in the form of a mat disposed on the ground of the passage and comprising:

a printed circuit (104, 404) comprising one face carrying a plurality of contactors (220) designed to change state under a pressure exerted by a foot or a wheel and at least one face carrying at least one electronic component (112, 412) not subjected to any pressure from the foot or wheel, and for the or each face carrying the one electronic component (112) not subjected to any pressure from the foot or wheel, a protective layer (106, 402) fixed against the face and incompressible under the weight of individuals or trolleys, the or each electronic component (112) being housed in a hole (110) in the incompressible protective layer (402, 106), a central system (302) intended to determine the number of individuals or trolleys and passing on the detection device from the information transmitted by the electronic component or components (112, 412) of the detection device (100, 400).

2. Counting system (300) according to claim 1, wherein the or each hole (110, 410) in the incompressible layer is a through hole.

3. Counting system (300) according to claim 1, wherein the electronic component or components (112, 412) not subjected to any pressure from the foot or wheel are active components receiving information from each contactor (220), analyzing the said information thus received, characterizing the feet or wheel that activate the said contactors (220) and transmitting said characterization to the central system (302).

4. Counting system (300) according to claim 1, wherein, when the printed circuit (104) carries on the same face one or more electronic components (112) and the plurality of contactors (220), the corresponding protective layer (106) forms an activation layer (106) comprising, for each contactor (220), a hammer (108) able to move elastically between an idle position in which it does not activate the contactor (220) and an activation position in which it does activate the contactor (220).

5. Counting system (300) according to claim 4, wherein it comprises:

a bottom protective layer (102) fixed to the printed circuit (104), capable of absorbing the irregularities in the ground without damaging the electronic components (112) integrated in the incompressible layer (106), a thermoformed intermediate layer (206) fixed between the printed circuit (104) and the activation layer (106), and a top protective layer (212) impervious to dust and water splashes, fixed to the activation layer (106).

6. Counting system (300) according to claim 1, wherein, when only the face of the printed circuit (404) opposite to the face carrying the plurality of contactors (220) carries one or more electronic components (412), the detection device (400) comprises a thermoformed activation layer (206) fixed to the face carrying the plurality of contactors (220) and comprising, for each contactor (220), an elastic zone (216) able to move vertically between an idle position in which it does not activate the contactor (220) and an activation position in which it does activate the said contactor (220).

7. Counting system (300) according to claim 6, wherein the elastic zone (216) comprises a protrusion (418) that extends above the top surface of the elastic zone (216), so that, when the elastic zone (216) is in the activation position, the protrusion (418) projects with respect to the top surface of the activation layer (206).

8. Counting system (300) according to claim 1, wherein, when there are several detection devices (100) in order to be able to adapt to different passage widths, said detection devices (100) are connected in steps by a series connection with n wires.

9. Counting system (300) according to claim 8, wherein connections of n wires between two consecutive detection devices (100, 400) are redundant.

10. Counting system (300) according to claim 1, wherein, when there are several detection devices (100, 400), said detection devices (100) are connected in steps by connection means of the flexible hinge type.

11. Counting system (300) according to claim 4, wherein the hammer (108) comprises a protrusion (218) that extends above the top surface of the hammer (108), so that, when the hammer (108) is in the activation position, the protrusion (218) projects with respect to the top surface of the activation layer (106).

12. Counting system (300) according to claim 1, wherein the central system (302) is intended to determine the direction of passage of each individual from the information transmitted by the electronic component or components (112, 412) of the detection device (100, 400).

* * * * *